US005408936A

United States Patent [19]

Tseng

[11] Patent Number: 5,408,936

[45] Date of Patent: Apr. 25, 1995

[54] RACK ASSEMBLY

[76] Inventor: Chun-Chu Tseng, No. 3, Ting-Hsi-Hsin, Lu-Man Tsun, Chu-Chi Hsiang, Chiayi Hsien, Taiwan, Prov. of China

[21] Appl. No.: 174,148

[22] Filed: Dec. 28, 1993

[51] Int. Cl.[6] ..... A47B 23/04

[52] U.S. Cl. ..... 108/42; 108/134; 108/40; 108/33; 211/90

[58] Field of Search ..... 108/33, 35, 38, 40, 108/42, 47, 48, 134; 211/90, 104, 150

[56] References Cited

U.S. PATENT DOCUMENTS

| | | | |
|---|---|---|---|
| 1,692,880 | 11/1928 | Wirth | 211/104 X |
| 2,010,990 | 8/1935 | Hoover | 108/33 |
| 2,031,287 | 2/1936 | Swanson | 108/134 |
| 2,650,145 | 8/1953 | Sieminski | 108/48 |
| 4,862,611 | 9/1989 | Wright | 108/38 |

FOREIGN PATENT DOCUMENTS

| | | | |
|---|---|---|---|
| 25628 | 3/1952 | Finland | 108/40 |
| 4121660 | 1/1993 | Germany | 108/47 |

*Primary Examiner*—James R. Brittain
*Assistant Examiner*—Robert J. Sandy
*Attorney, Agent, or Firm*—Baker & Daniels

[57] ABSTRACT

The rack assembly includes a pair of mounting struts which are disposed spacedly in a parallel relationship and which are respectively formed with an elongated groove that has a lower end provided with an engaging member and an upper end. A plate member has two opposed end edges and two opposed side edges. One of the end edges of the plate member is disposed between the struts. Each of the side edges of the plate member has a positioning projection extending into an adjacent one of the guiding grooves. A connecting rod has a first end pivoted to one of the struts at a position above the upper end of the guiding groove and a second end pivoted to an adjacent side edge of the plate member to permit engagement between the engaging members and the positioning projections of plate member when the positioning projections of the plate member are moved to the lower ends of the guiding grooves of the struts.

5 Claims, 6 Drawing Sheets 32
520
52
312
51
314
A
511
51
51
41
314
3
43
31

RACK ASSEMBLY

BACKGROUND OF THE INVENTION

1. Field of the Invention

The invention relates to a rack assembly, more particularly to a rack assembly which is to be mounted on an upright wall and which includes a plate member that is foldable relative to the upright wall.

2. Description of the Related Art

Referring to FIG. 1, a conventional rack assembly is shown to comprise a plate member 21 and a pair of braces 22 which are used to mount the plate member 21 fixedly on an upright wall.

Note that the plate member 21 of the conventional rack assembly cannot be folded with respect to the upright wall. Thus, the conventional rack assembly occupies precious space when it is not in use.

SUMMARY OF THE INVENTION

The main objective of the present invention is to provide a rack assembly which is to be mounted on an upright wall and which includes a plate member that can be folded with respect to the upright wall so as to minimize the space occupied thereby when the rack assembly is not in use.

According to the present invention, the rack assembly includes a pair of mounting struts disposed spacedly in a parallel relationship. Each of the mounting struts has an elongated guiding groove formed along the length thereof. Each of the guiding grooves has a lower end which is provided with an engaging member and an upper end opposite to the lower end. A plate member has a pair of opposed end edges and a pair of opposed side edges which interconnect the pair of opposed end edges. One of the opposed end edges of the plate member is disposed between the elongated grooves of the struts and is substantially perpendicular to the struts. Each of the opposed side edges of the plate member has a positioning projection which is formed adjacent to said one of the opposed end edges and which extends movably into an adjacent one of the guiding grooves of the struts. A connecting rod has a first end connected pivotally to one of the struts above the upper end of the elongated groove and a second end connected pivotally to an adjacent one the opposed side edges of the plate member to keep the plate member perpendicular to the struts when the positioning projections are moved to the lower ends of the guiding grooves and engaged the engaging members.

The connecting rod further has an engaging unit for engaging the positioning projections of the plate member when the positioning projections are moved to a position in which the plate member is parallel with the struts.

The plate member can be further provided with a support leg connected pivotally to adjacent to a remaining one of the opposed end edges of the plate member. The support leg is pivotable relative to the plate member between a first position, wherein the support leg lies against the plate member, and a second position, wherein the support leg is perpendicular with the plate member. At the second position, the plate member can serve as a table or bed. To minimize the space occupied by the plate member when the rack assembly is not in use, the support leg can be folded with respect to the plate member to the first position. Then the plate member can be folded relative to the struts.

BRIEF DESCRIPTION OF THE DRAWINGS

Other features and advantages of the present invention will become more apparent in the following detailed description of the preferred embodiments, with reference to the accompanying drawings, in which.

DETAILED DESCRIPTION OF THE PREFERRED EMBODIMENTS

Figure 1:
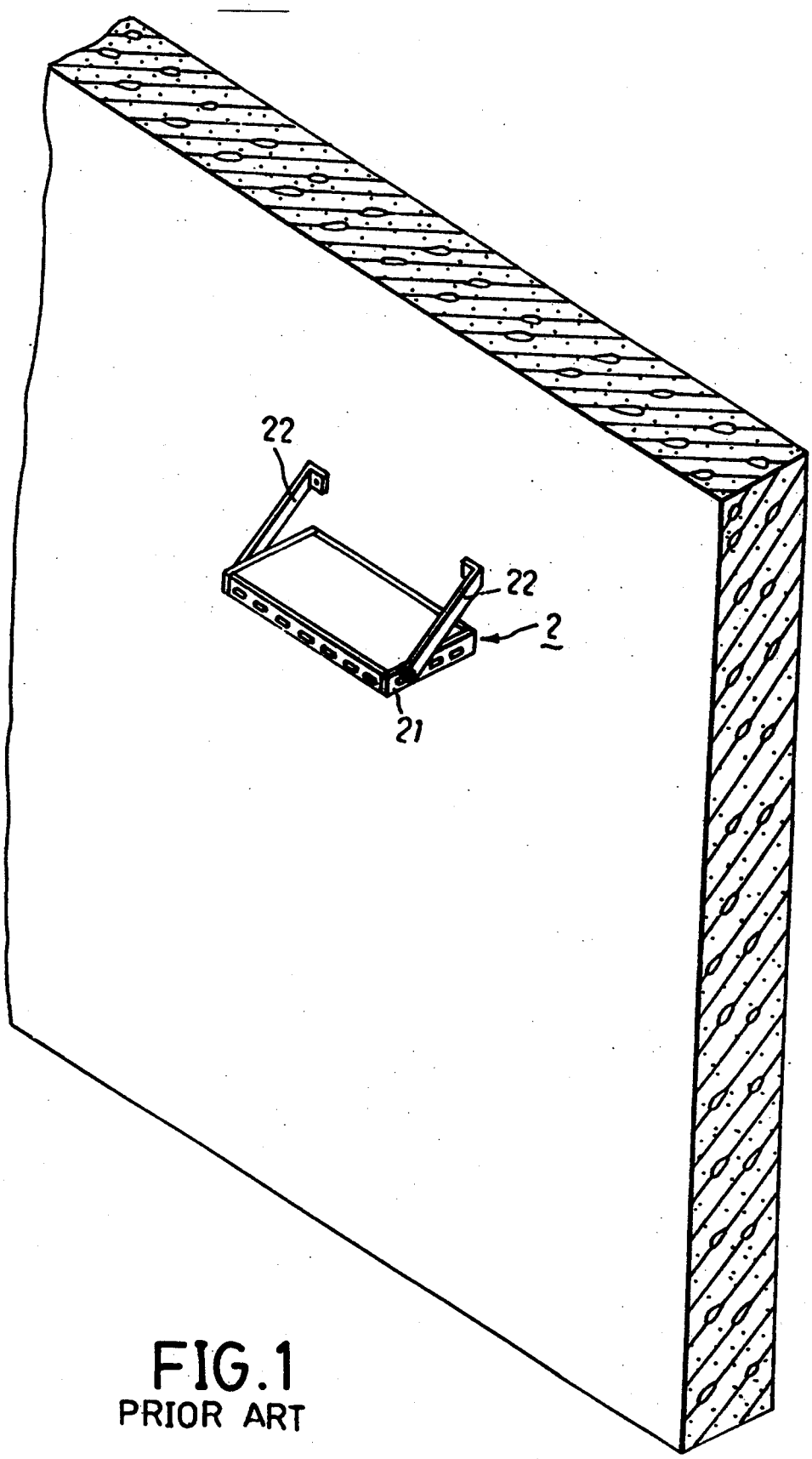
FIG. 1 PRIOR ART
FIG. 1 shows a conventional rack assembly mounted on a wall.

Before the present invention is described in greater detail, it should be noted that like elements are indicated by the same reference numerals throughout the disclosure.

Figure 2:
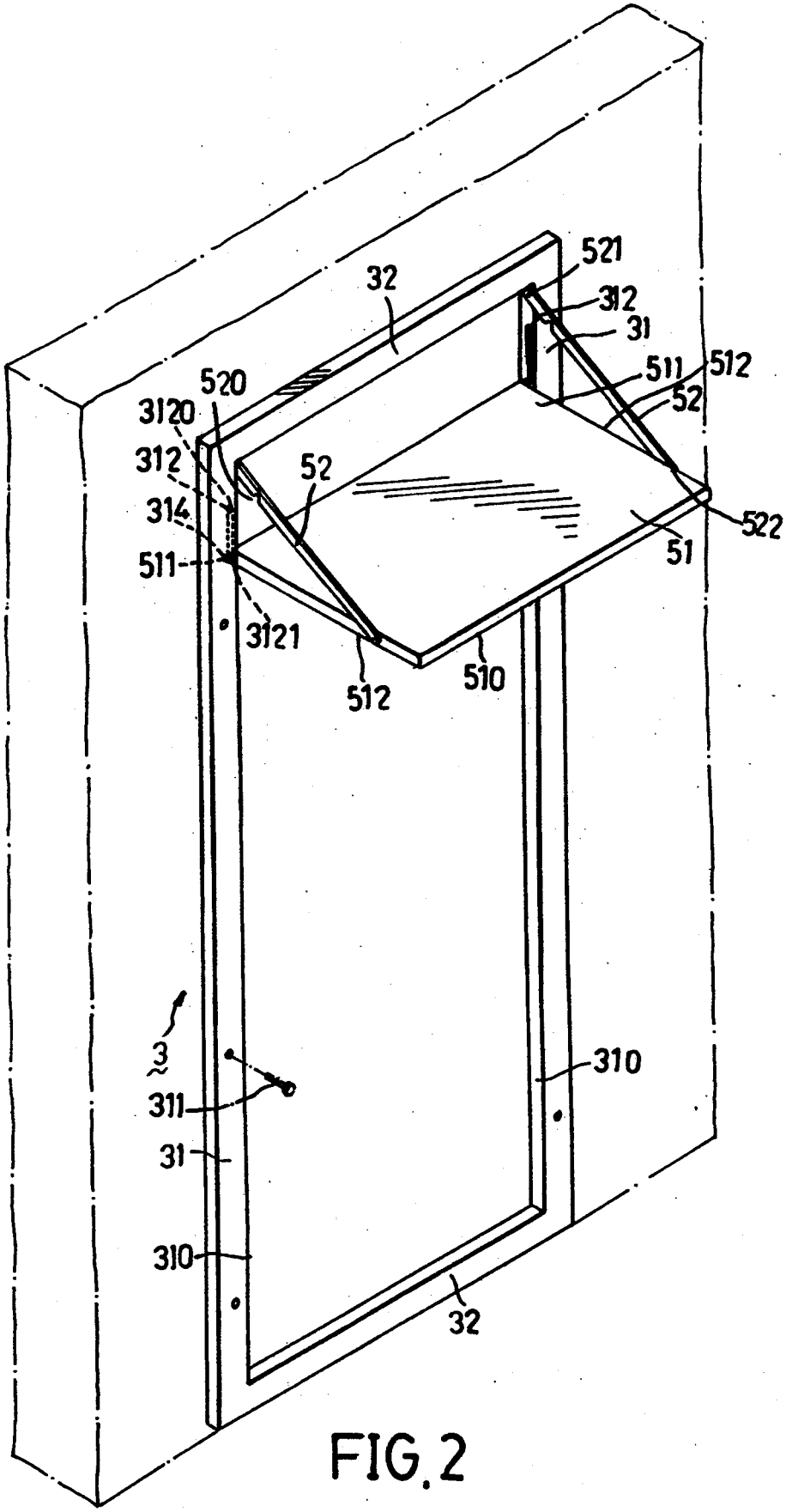
FIG. 2 shows a first preferred embodiment of a rack assembly of the present invention when in use.

Referring to FIG. 2, a first preferred embodiment of a rack assembly of the present invention includes a frame member 3, a plate member 51 and a pair of connecting rods 52.

As best illustrated, the frame member 3 includes a pair of mounting struts 31 and a pair of connecting beams 32 which interconnect the mounting struts 31 so as to dispose the struts 31 in a parallel relationship. Each of the struts 31 has an inner side and an outer side. The struts 1 are formed with a plurality of mounting holes 310 that extend from the outer side to the inner side of the same. The locking bolts 311 are inserted through the mounting holes 310 to mount the frame 3 on an upright wall 10, wherein the inner side of the struts 1 abuts against the upright wall 10.

Each of the struts 31 has an elongated guiding groove 312 which has a predetermined length and which is formed along the length of the respective strut 31. The guiding grooves 312 of the struts 31 are facing and are aligned with each other. Each of the guiding grooves 312 has an upper end 3120 and a lower end 3121 opposite to the upper end 3120. The lower end 3121 of each of the guiding grooves 312 is provided with an engaging member 314, such as a notch, which extends toward the inner side of the respective strut 31 and which is communicated with the guiding groove 312.

The plate member 51 has a pair of opposed end edges 510 and a pair of opposed side edges 512 which interconnect the pair of opposed end edges 510. The plate member 51 is inserted from the outer sides of the struts 31 so as to dispose one of the opposed end edges 510 of the plate member 51 between the guiding grooves 312. Each of the opposed side edges 512 of the plate member 51 has a positioning projection 511 which extends into an adjacent one of the guiding grooves 312 and which is movable therealong.

Each of the connecting rods 52 has a first end 521 connected pivotally to a respective one of the struts 31 at a position above the upper end 3120 of the guiding groove 312 and a second end 522 which is connected pivotally to an adjacent one of the side edges 512 of the plate member 51 so as to dispose the plate member 51 in a substantially perpendicular position with respect to the struts 31 when the positioning projections 511 of the plate member 51 are moved to the lower ends 3121 of the guiding grooves 312 of the struts 31 so as to engage the engaging members 314.

Figure 3:
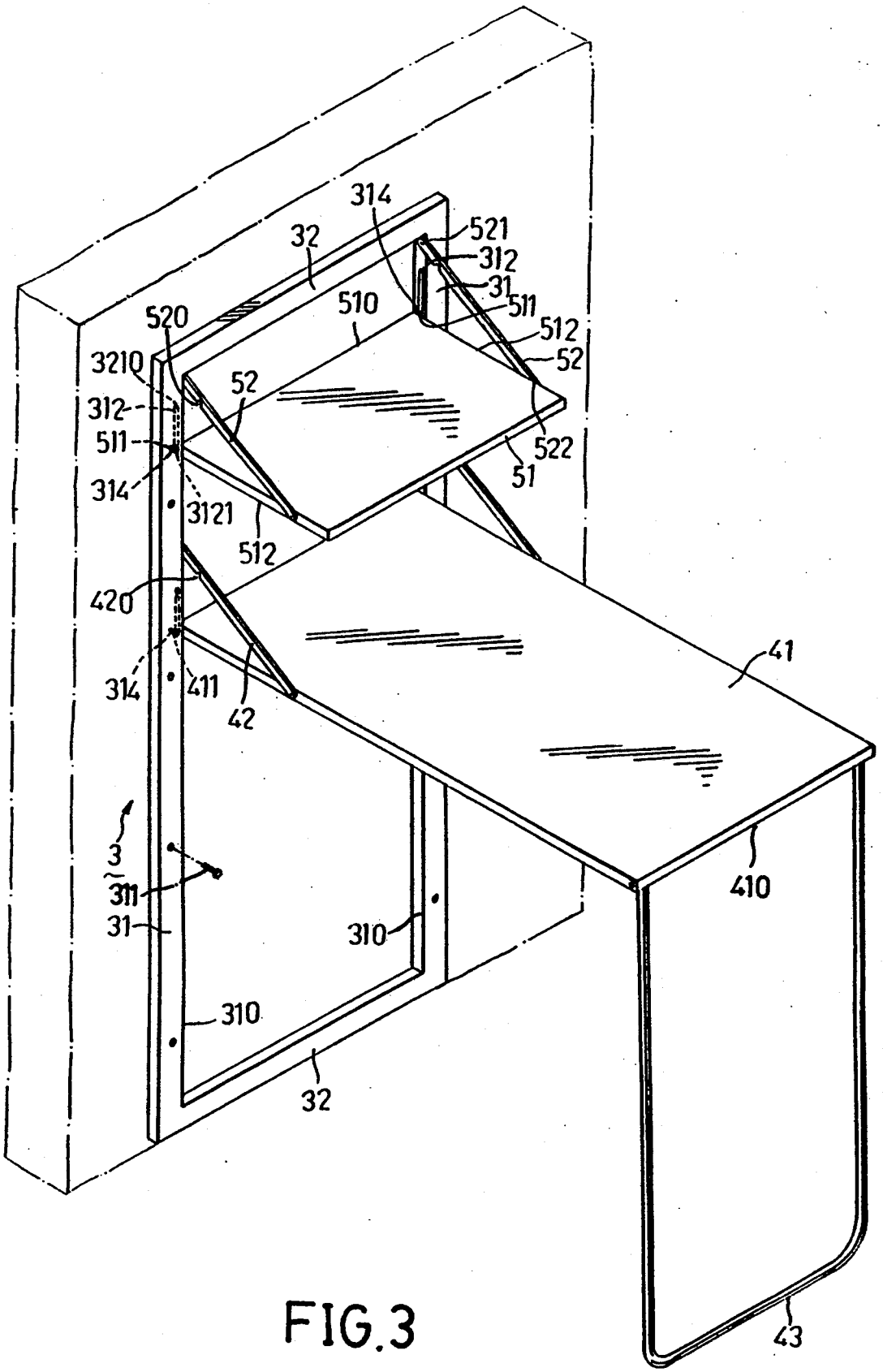
FIG. 3 shows a second preferred embodiment of a rack assembly of the present invention when in use.

Referring to FIG. 3, in a second preferred embodiment, the rack assembly of the present invention includes two plate members 51, 41 mounted to the struts 31 of the frame member 3 in the previously described manner except that the plate member 41 further includes a U-shaped support leg 43 connected pivotally to the opposed side edges thereof at a position adjacent to the remaining one 410 of the end edges of the plate member 41. The U-shaped support leg 43 can be pivoted relative to the plate member 41 between a first position, wherein the support leg 43 lies against the plate member 41, and a second position, wherein the support leg 43 is perpendicular to the plate member 41. At the second position, the plate member 41 can be used as a table or bed, while the plate member 51 can be used as a book shelf.

Figure 4:
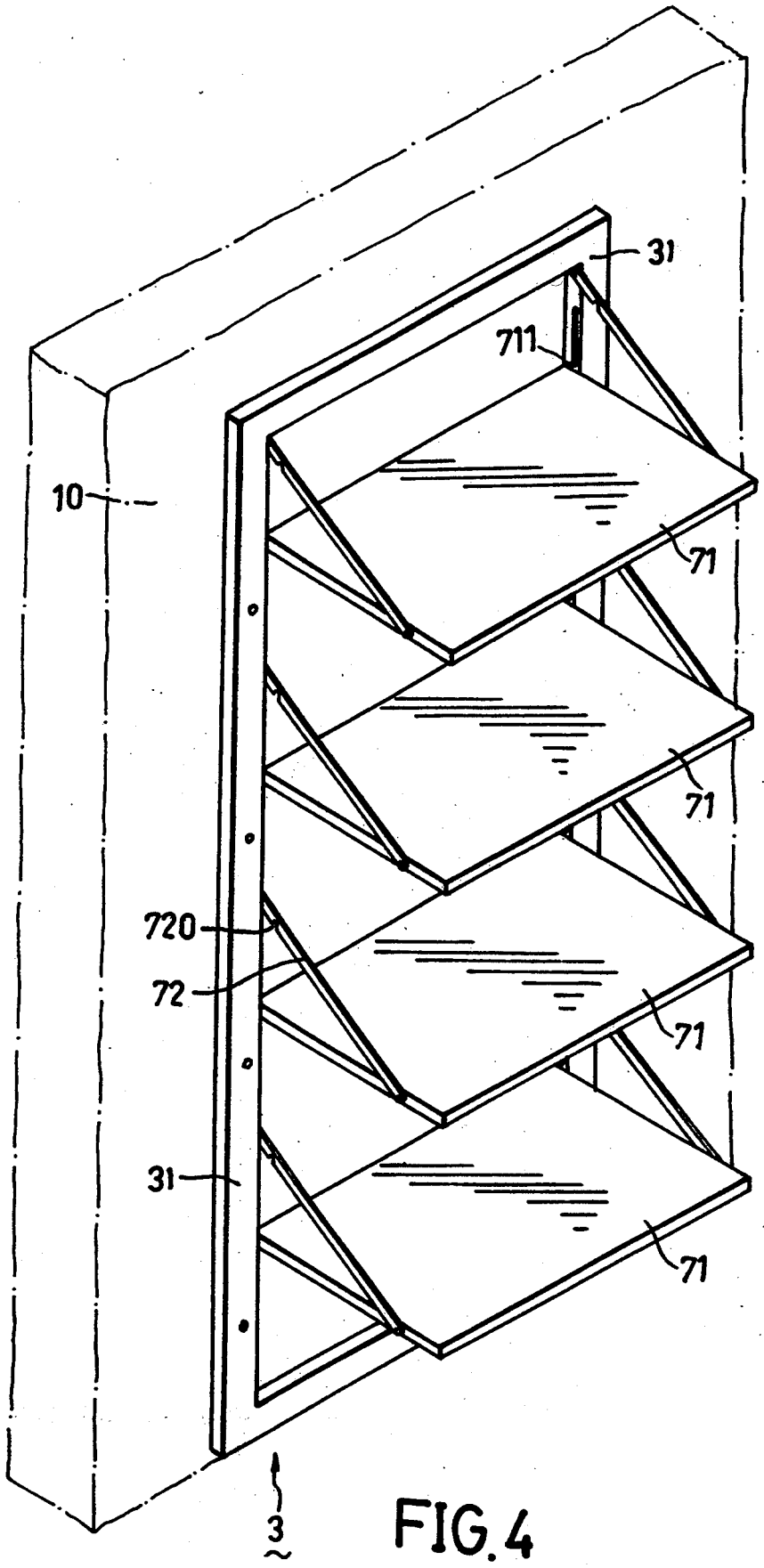
FIG. 4 shows a third preferred embodiment of a rack assembly of the present invention.

Referring to FIG. 4, the third preferred embodiment of the rack assembly of the present invention is shown to comprise four plate members 71 which are mounted to the struts 31 in a manner similar to that described in the preceding paragraphs.

Figure 5:
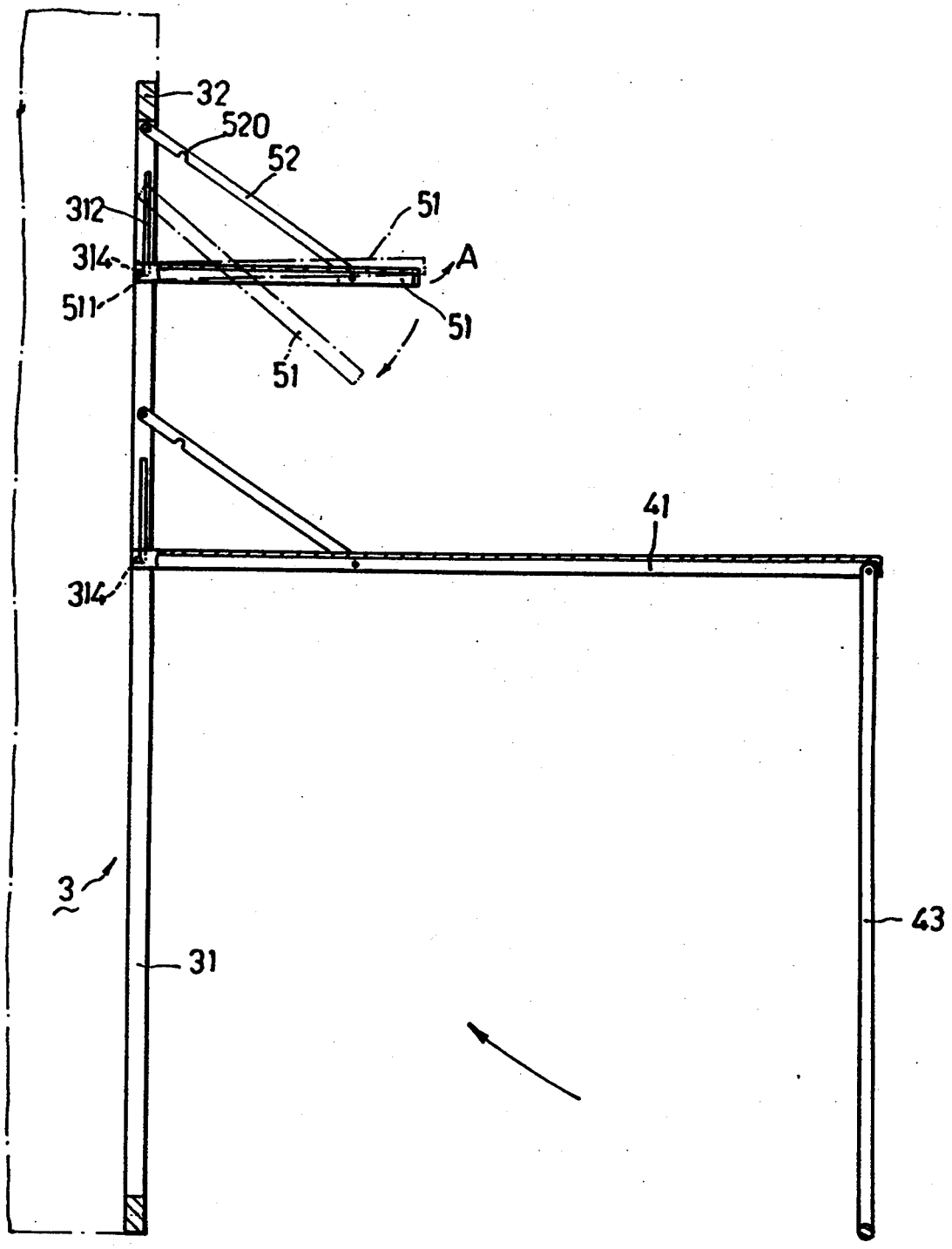
FIG. 5 illustrates a sectional view and the folding steps of the rack assembly shown in FIG. 3.

The operation of all the preferred embodiments is explained with reference FIG. 5. When storing the plate member 51, the plate member 51 is pulled outward relative to the struts 31 in the direction indicated by the arrow (A) so as to disengage the positioning projections 511 from the engaging members 314 of the guiding grooves 312. The plate member 51 is then pushed toward the struts 31, wherein the positioning projections 511 of the plate member 51 slides up the guiding grooves 312 so as to dispose the plate member 51 in a stored position, wherein the plate member 51 is substantially parallel with the struts 31.

During the folding operation of the plate member 41 relative to the struts 31, the support leg 43 is pivoted relative to the plate member 41 to the first position, after which the plate member 41 can be folded relative to the struts 31.

Figure 6:
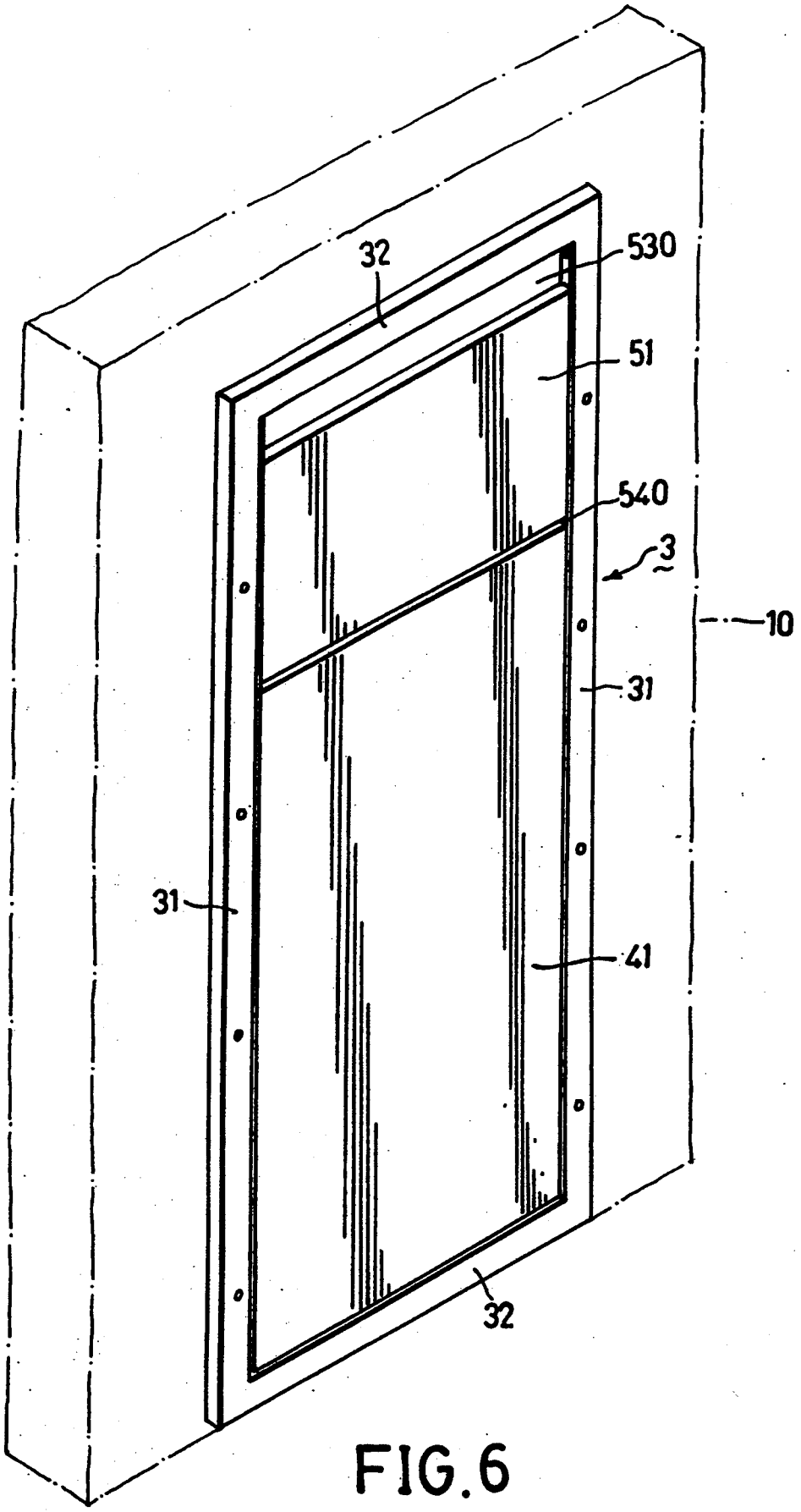
FIG. 6 illustrates the rack assembly shown in FIG. 3 when in a stored position.

Note that in order to retain each of the plate members 51, 41, 71 stationary between the struts 31 at the stored position, each of the connecting rods 52, 42, 72 is provided with an engaging unit 520, 420, 720, in the form of a notch, which engages the respective one of the positioning projections 511, 411, 711 of the respective plate member 51, 41, 71 when the latter is at the stored position, as shown in FIG. 6.

Referring again to FIG. 6, when the plate members 51 and 41 are at the stored position, a first clearance 530 is formed between the top connecting beam 32 and the plate member 51, while a second clearance 540 is formed between the plate members 51, 41. Each of the clearances 530, 540 permits the insertion of a finger so that the upper end edge of the respective plate member 51, 41 can be depressed, wherein the positioning projections 511, 411 of the respective plate member 51, 41 slide toward the lower end of the respective guiding groove 312 to engage the respective engaging member 314 so as to retain the plate member 51, 41 perpendicular to the struts 31, as shown in FIGS. 3 and 5. Thus, the plate members 51, 41 extend perpendicularly and stably relative to the struts 31.

While preferred embodiments have been described and explained, it will be apparent that many changes and modifications can be made in the general construction and arrangement of the present invention without departing from the scope and spirit thereof. Therefore, it is described that the present invention be not limited to the exact disclosure but only to the extent of the appended claims.

I claim:

1. A rack assembly characterized by:

a pair of mounting struts disposed spacedly in a parallel relationship, each of said mounting struts having an elongated guiding groove formed along a length thereof, each of said elongated guiding grooves facing and being aligned with the other one of said elongated guiding grooves and having a lower end which is provided with an engaging member and an upper end opposite to said lower end;

a plate member having a pair of opposed end edges, and a pair of opposed side edges which interconnect said pair of opposed end edges, one of said pair of opposed end edges being disposed between said guiding grooves of said struts and being substantially perpendicular to said pair of struts, each of said pair of opposed side edges having a positioning projection which is formed adjacent to said one of said pair of end edges and extending movably into an adjacent one of said guiding grooves of said pair of struts; and a connecting rod having a first end connected pivotally to one of said struts at a position above said upper end of said elongated groove of said one of said struts, and a second end connected pivotally to an adjacent one of said opposed side edges of said plate member to keep said plate member perpendicular to said pair of mounting struts when said positioning projections are moved to said lower ends of said guiding grooves and engage said engaging members.

2. The rack assembly as defined in claim 1, wherein said connecting rod further has an engaging unit to engage said positioning projection of said adjacent one of said opposed side edges when said plate member is parallel to said pair of mounting struts.

3. The rack assembly as defined in claim 1, wherein said plate member further has a support leg connected pivotally adjacent to a remaining one of said opposed end edges, said support leg being pivotable relative to said plate member between a first position, wherein said support leg lies against said plate member, and a second position, wherein said support leg is perpendicular to said plate member.

4. The rack assembly as defined in claim 1, wherein each of said pair of struts has a plurality of mounting holes formed therethrough for mounting on an upright wall.

5. The rack assembly as defined in claim 1, wherein said rack assembly further includes two connecting beams which interconnect said pair of struts to form a rectangular frame.

* * * * *